US006399929B1

(12) United States Patent
Hanton et al.

(10) Patent No.: US 6,399,929 B1
(45) Date of Patent: Jun. 4, 2002

(54) INDUCTION HEATER COMPRISING A COIL/CAPACITOR BANK COMBINATION INCLUDING A TRANSLATABLE COIL ASSEMBLY FOR MOVEMENT ON AND OFF A CONTINUOUS STRIP

(75) Inventors: David J. Hanton, Vienna; Maochang Cao, Warren; David W. Adair, Canfield, all of OH (US)

(73) Assignee: Ajax Magnethermic Corporation, Warren, OH (US)

( * ) Notice: Subject to any disclaimer, the term of this patent is extended or adjusted under 35 U.S.C. 154(b) by 0 days.

(21) Appl. No.: 09/571,308

(22) Filed: May 12, 2000

(51) Int. Cl.[7] ..... H05B 6/02; H05B 6/36

(52) U.S. Cl. ..... 219/645; 219/647; 219/661; 219/672; 219/654; 219/676; 219/632; 361/274.3; 361/688

(58) Field of Search ..... 219/645, 646, 219/635, 647, 653, 656, 660, 661, 670, 672, 673, 674, 677, 632, 654, 676; 361/274.2, 274.3, 328, 688, 689, 690, 694, 697

(56) References Cited

U.S. PATENT DOCUMENTS

| | | | | |
|---|---|---|---|---|
| 1,768,430 | A | | 6/1930 | Van Deventer |
| 1,852,718 | A | | 4/1932 | Haefely |
| 1,861,006 | A | | 5/1932 | Goodman |
| 1,945,108 | A | | 1/1934 | Dubilier |
| 2,577,487 | A | | 12/1951 | Serota |
| 3,141,999 | A | | 7/1964 | Schneider |
| 3,593,066 | A | | 7/1971 | Norman, Sr. |
| 3,692,969 | A | * | 9/1972 | Kasper ..... 219/646 |
| 3,705,285 | A | * | 12/1972 | Cachat ..... 219/673 |
| 4,095,264 | A | | 6/1978 | Danemar et al. |
| 4,447,854 | A | | 5/1984 | Markarian |
| 4,464,702 | A | | 8/1984 | Miller et al. |
| 4,507,630 | A | | 3/1985 | Wakino |
| 4,670,814 | A | | 6/1987 | Matsui et al. |
| 4,677,523 | A | | 6/1987 | Kauppi |
| 4,761,530 | A | | 8/1988 | Scherer et al. |
| 5,034,586 | A | | 7/1991 | Havas et al. |
| 5,317,121 | A | | 5/1994 | Katayama et al. |
| 5,327,316 | A | * | 7/1994 | Yi ..... 361/56 |
| 5,475,272 | A | | 12/1995 | Gothelf |
| 5,530,618 | A | | 6/1996 | Carroll et al. |
| 5,837,976 | A | | 11/1998 | Loveless et al. |
| 5,940,263 | A | | 8/1999 | Jakoubovitch |
| 5,953,201 | A | | 9/1999 | Jakoubovitch |

FOREIGN PATENT DOCUMENTS

| | | |
|---|---|---|
| JP | 56-153719 | * 11/1981 |
| JP | 2-305928 | 12/1990 |

* cited by examiner

*Primary Examiner*—Philip H. Leung
(74) *Attorney, Agent, or Firm*—Fay, Sharpe, Fagan, Minnich & McKee, LLP

(57) ABSTRACT

A coil/capacitor combination useable as an induction furnace includes a reactive capacitor bank directly bolted to the coil and protected from coil fields by shields and heat sink plates. The coil includes a selectively openable switch for placing the coil assembly on and off of a moving strip. The switch is operated by deflecting coil turns within the natural resiliency of the turns themselves.

25 Claims, 6 Drawing Sheets

FIG. 1
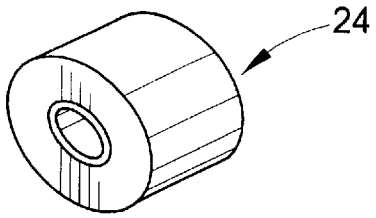
FIG. 2
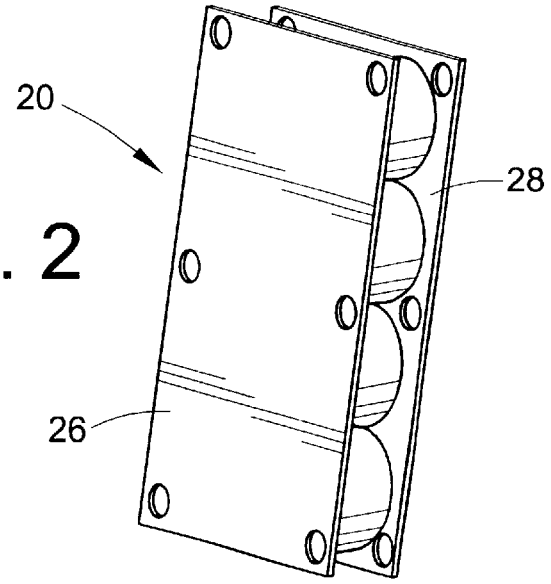
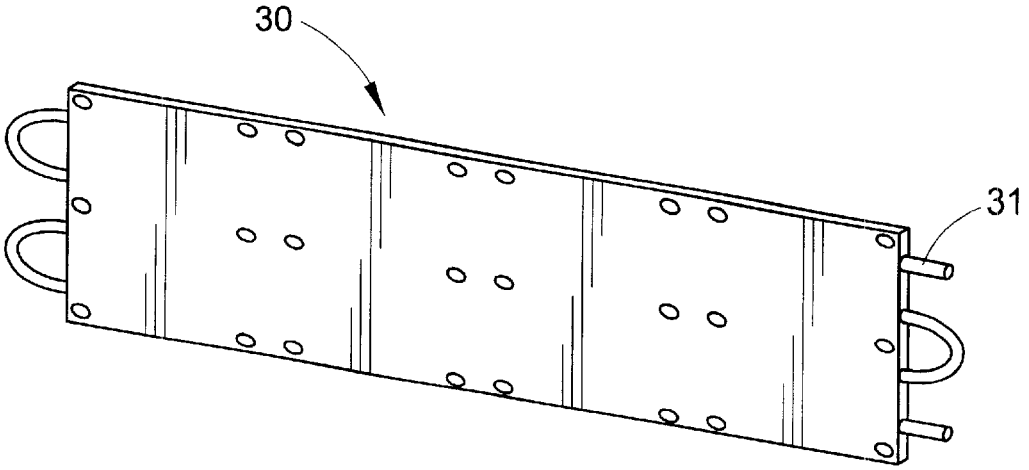
FIG. 3

INDUCTION HEATER COMPRISING A COIL/CAPACITOR BANK COMBINATION INCLUDING A TRANSLATABLE COIL ASSEMBLY FOR MOVEMENT ON AND OFF A CONTINUOUS STRIP

BACKGROUND OF THE INVENTION

The subject invention relates to electric induction furnaces for heat treating a running length of metal, such as steel or aluminum, and more particularly, to an improved assembly facilitating a greater convenience of coil movement on and off of the continuous strip.

Heating of a continuous strip with an induction furnace is well known. Commonly assigned U.S. Pat. No. 4,761,530 shows such an assembly. To the extent that the teachings of this patent can clarify or supplement the disclosure of the subject invention in this application, it is hereby incorporated by reference. Such heating assemblies have particular application in galvanizing or galvannealing operations, and the workpiece being treated is usually a running continuous strip of metal. Practical problems with such an operation concern the separation or removal of the furnace coils from about the strip without cutting the strip, or disassembling the heating apparatus. The '530 patent noted above discloses one way of avoiding cutting or disassembly is to construct the coil to have a sidewall segment comprised of a hinged door, which door may be selectively opened or closed by a piston and cylinder actuator. When the door is closed, the coil is formed into a closed loop and can function as a normal solenoidal coil about the workpiece. When the door is opened, the loop has an open segment which will allow the coil to be moved off the strip for adjustment, maintenance or the like. The coil can also be moved back onto the strip, and then the door closed to form the closed loop and resume the intended heating operation. The '530 patent shows a wheeled carriage assembly which supports the coil and facilitates the translation of the coil on or away from the strip when the coil door is opened.

There are two particular problems in the design of a furnace for this intended purpose. First, a running strip is a very dangerous item particularly for coolant hoses and electrical cables in that any contact with the running strip will result in a sawing action that can quickly cut the contacting item. Accordingly, the furnace design must be very careful to space the furnace components to avoid any such contact. An even better solution is to minimize the need for coolant hoses or electrical cables, particularly in the area of the strip.

The other problem is that in most induction coil applications, the current in the load coil is higher than other power components and the current is largely reactive. As such, it is advantageous to supply the reactive portion of the coil current from a capacitor bank located as close as possible to the induction coil to minimize the losses between the bank and the coil. Apart from the cable connecting problems mentioned above, the proximity to the coil enhances the consequences of the field effects of the coil on the bank. When such effects can cause an unacceptable heating of the bank, the prior art suggests spacing the bank away from the coil.

Another problem with the system shown in the '530 patent above apart from the complexity itself with a hinged door, is that the nature of the high frequency currents in such an assembly are that they run on the inside surfaces of the coil. In the switch assembly of the '530 patent the switch blades are disposed so that the current, instead of running down the wide part of the knife blade, actually runs down the edge of the knife. It is better that the switch can emulate a piece of bus bar, i.e., by providing a surface area greater than the knife edge, the more efficient and the lower the losses will be, for the connection.

The present invention contemplates a new and improved apparatus which overcomes all of the above-referred to problems and others to provide a new induction heating assembly for preferably heating a running strip which is simple in design, economical to manufacture, readily adaptable to a variety of dimensional characteristics, is rugged and reliable in its operation, provides improved heating efficiency, increased reliability and reduced assembly cost.

BRIEF SUMMARY OF THE INVENTION

In accordance with the present invention, there is provided an electric induction heating assembly comprising an induction coil for heating a workpiece passing therethrough and a capacitor bank for supplying a reactive portion of current to the coil wherein the bank is disposed adjacent the coil and includes a housing configured for shielding capacitors within the bank from a magnetic field of the coil. The bank is preferably fastened to the coil and includes a conduit in communication with a source of coolant for cooling the banks.

In accordance with another aspect of the present invention, the housing comprises an electrically and thermally conductive heat sink, and the bank comprises a plurality of capacitors, each configured as a toroidal roll pack disposed between a first and second of the heat sink. A collector bus is in electrical communication with the capacitors and the coil. In one embodiment a plurality of the roll packs are serially connected to the bus and each of the roll packs is interposed between a pair of the plurality of heat sinks for forming a stack.

In accordance with another aspect of the present invention, the coil includes a selectively openable switch and an actuator for deforming the coil to open the switch with a spacing sized for moving the assembly on and off of a running strip. A moveable carriage supports the coil and the capacitor bank.

In accordance with the present invention, an induction heater is provided for heating a continuous strip wherein the heater is selectively moved on and off the strip. The heater comprises a closed loop coil disposed about the strip. An accessway is included within the coil for selectively opening the coil for the movement relative to the strip. The accessway comprises a switch supported by a turn of the coil. An actuator is associated with the turn for deflecting the turn to an extent to open the switch.

In accordance with another aspect of the present invention, the switch comprises a knife switch extending for a length of the coil. The actuator preferably comprises a piston and cylinder assembly supported on a base frame and fastened to the coil for the deflecting of the coil turn.

In accordance with another aspect of the present invention, the heater includes a flat pack capacitor bank in electrical communication with the coil. The bank and the coil are supported on a trolley for movement on and off the strip.

One benefit obtained by use of the present invention is an induction heating assembly comprising a carriage mounted coil wherein the coil and an associated capacitor bank are packaged in the assembly for reduced space consumption.

Another benefit is an assembly with a reduced number of coolant hoses and cable connections adjacent the coil and a running strip passing through the coil.

Another benefit is an openable coil including a knife switch wherein the coil has the advantages of lower losses, increased reliability, less sensitivity to alignment, lower switch costs, and which avoids end water and cooling hose connections.

Yet another advantage of the present invention is a flat pack capacitor pack which can be bolted directly to the coil, but which avoids harmful heating of the capacitor bank by appropriate shielding and cooling.

Another benefits and advantages of the subject new induction heating assembly will become apparent to those skilled in the art upon a reading and understanding of this specification.

BRIEF DESCRIPTION OF THE DRAWINGS

The invention may take physical form in certain parts and arrangements of parts, the preferred embodiments of which will be described in detail in the specification and illustrated in the accompanying drawings, which form a part hereof and wherein:

FIG. 1 is a perspective view of a single roll pack capacitor;

FIG. 2 is a perspective view of a set of capacitors assembled between opposed cooling and shielding heat sink plates;

FIG. 3 is an elevated perspective view of a single heat sink plate, particularly showing the coolant tubes extending from the end portions thereof;

DETAILED DESCRIPTION OF THE PREFERRED EMBODIMENTS

Figure 8:
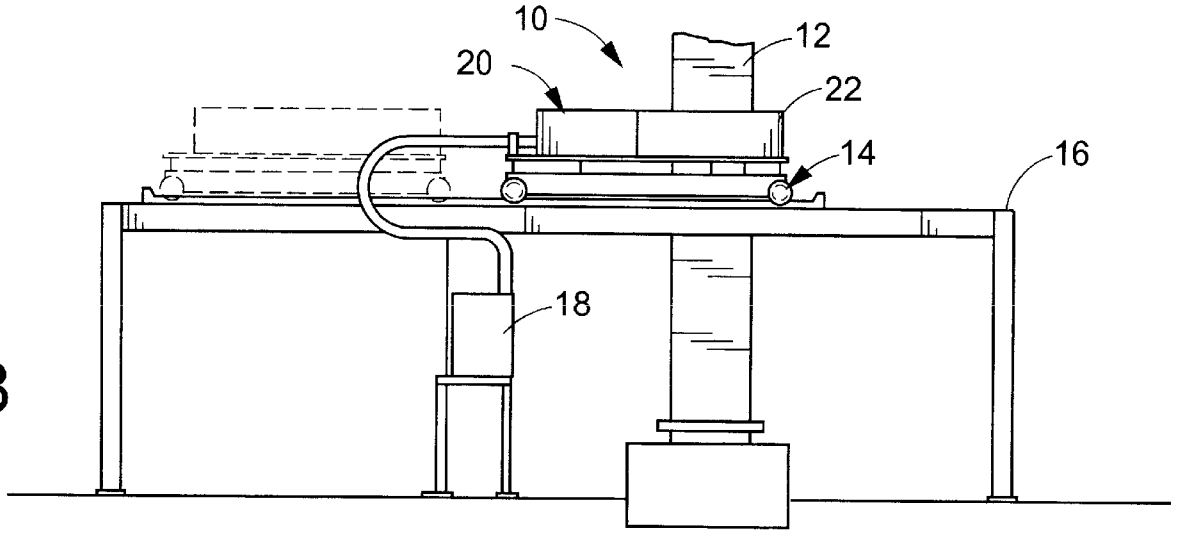
FIG. 8 is a side-elevational view showing a strip heating assembly including a coil capacitor apparatus formed in accordance with the present invention.

Referring now to the drawings wherein the showings are for purposes of illustrating the preferred embodiments of the invention only and not for purposes of limiting same, the Figures show an induction heating assembly 10 useful for heating a moving workpiece such as strip steel or aluminum 12 (FIG. 8). Since the strip 12 is continuous, assembly 10 must include some means for allowing the coil componentry surrounding the strip 12 to be opened so that the coil can be moved on and off of the strip. A wheeled trolley 14 is convenient for moving the coil assembly. A conventional frame 16 supports the trolley, and therefore the coil. A power supply 18 supplies the energy to the coil through a capacitor bank 20 as hereinafter will be more fully explained.

It is a principal purpose of the subject invention that the coil assembly 22, capacitor bank 20, opening and closing switch (FIG. 10) and associated shielding can be packaged so as to require a smaller space requirement than prior known assemblies, so that the coil/capacitor bank assembly can be placed with convenience on the trolley 14 in an area where the strip 12 is, i.e., where space is a premium in a fully operational assembly, while the power supply 18 can be disposed off the trolley 14 in less expensive space area within the overall system 10. Effectively, the invention comprises the grouping of the switch, coil 22 and capacitor bank 20 as a single assembled entity, conveniently mounted on a trolley 14 for improved ease of application to and removal from the strip 12. The close proximity of the bank and coil not only promotes improved electrical efficiencies, but also enhanced constructural safety and simplicity.

Figure 4:
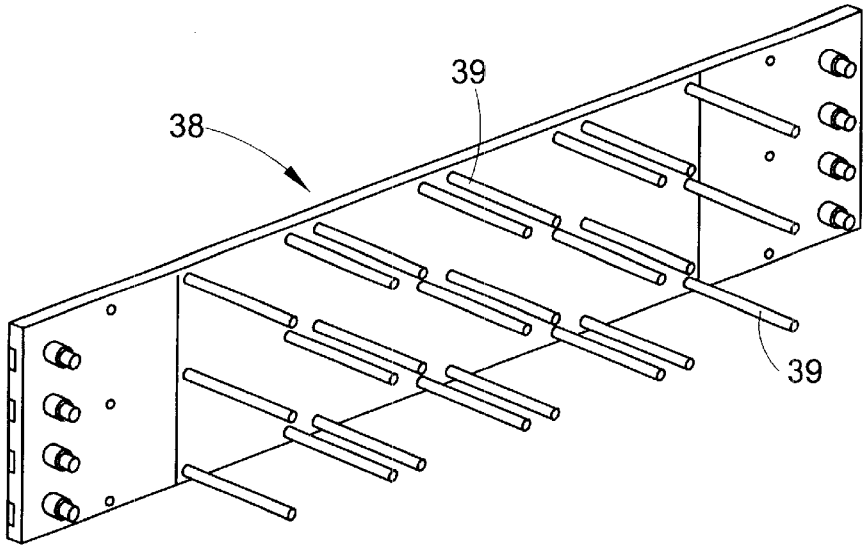
FIG. 4 is a perspective view of a collector bus which is in electrical communication with the capacitor group and a coil.
Figure 5:
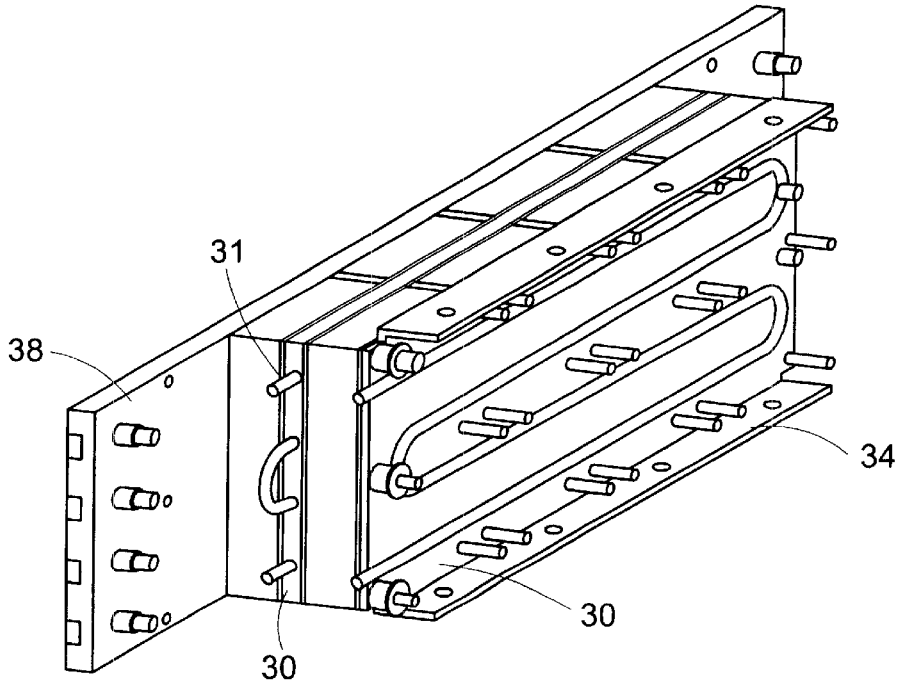
FIG. 5 is a perspective view of a stacked assembly comprising the flat pack and capacitor bank.

With reference to FIGS. 1 and 2, a reactive capacitor bank is well known as a component of an induction heating coil. The bank is comprised of a plurality of single roll-pack capacitors which are wound in a hockey puck type of shape. As shown in FIG. 2, the single roll packs 24 are assembled in parallel as a group and then are soldered to opposed copper plates 26, 28 forming sidewalls of each associated group. A plurality of such a group of assemblies are connected in electrical series and then the entire assembly forms the capacitor bank. FIG. 5 shows two such capacitor groups so assembled. It also shows a plurality of multi-capacitor water cooled heat sink plates 30 adjacent the groups. Keeping in mind that it is a design objective of the subject invention to dispose the capacitor bank in a position so close to the coil 22, that field effects from the coil can reach the capacitor bank, the sinks 30 are electrically and thermically conductive and thus serve to facilitate cooling of the capacitor banks as well as enhanced shielding from field effects. Cooling conduit 31 draws heat from the plate 30.

Figure 7:
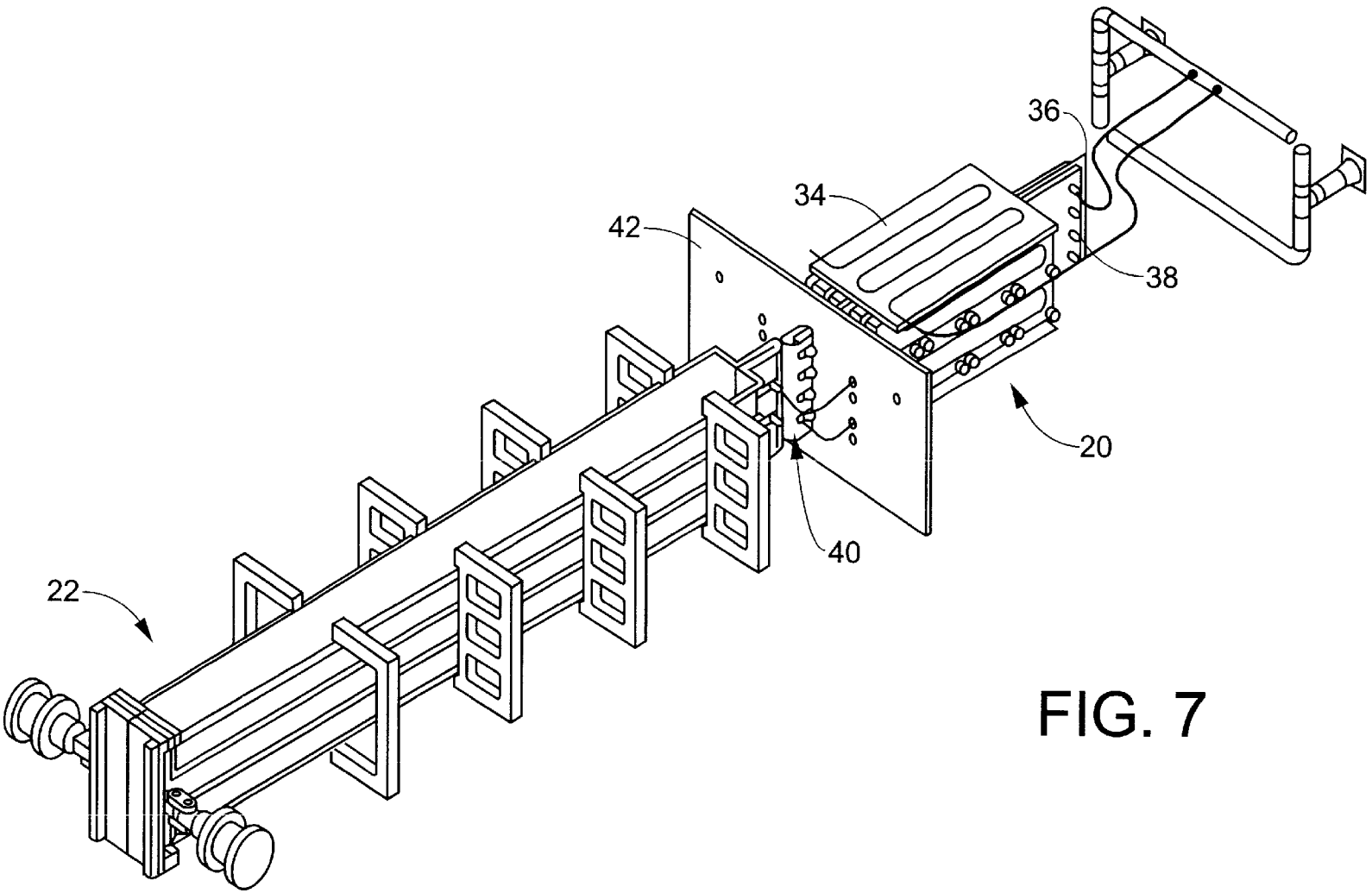
FIG. 7 is a view similar to FIG. 6 except the wall housings have been removed for ease in illustrating internal componentry.

Turning to FIGS. 5 and 7, it can be seen that the capacitor bank further includes an additional shielding plate 34 located on both the top and bottom of the assembled group. Plate 34 serves as an end or pressure plate for holding the assembly together. In the commercial embodiment illustrated in FIG. 7, actually four capacitor groups are illustrated. In effect, the embodiment of FIG. 3 is duplicated on both sides of an insulating plate 36, a collector bus 38 communicates electrical energy to the capacitors of the group supported on bus 39 pegs. It is an important feature of the invention to facilitate the direct bolting of the capacitor bank assembly directly to the coil 22 to locate the coil and bank immediately adjacent one another. Housing shield 34 and heat sinks 30 cooperate to permit the disposition of the capacitors so close to the coil.

With continued reference to FIG. 7, it can be seen that the collector bus 38 is connected at one end to power supply 18 through appropriate connection cables, while at the other end 40 is directly bolted to the coil 22. Shield plate 42 is disposed intermediate the capacitor bank 20 and the coil 22.

Figure 6:
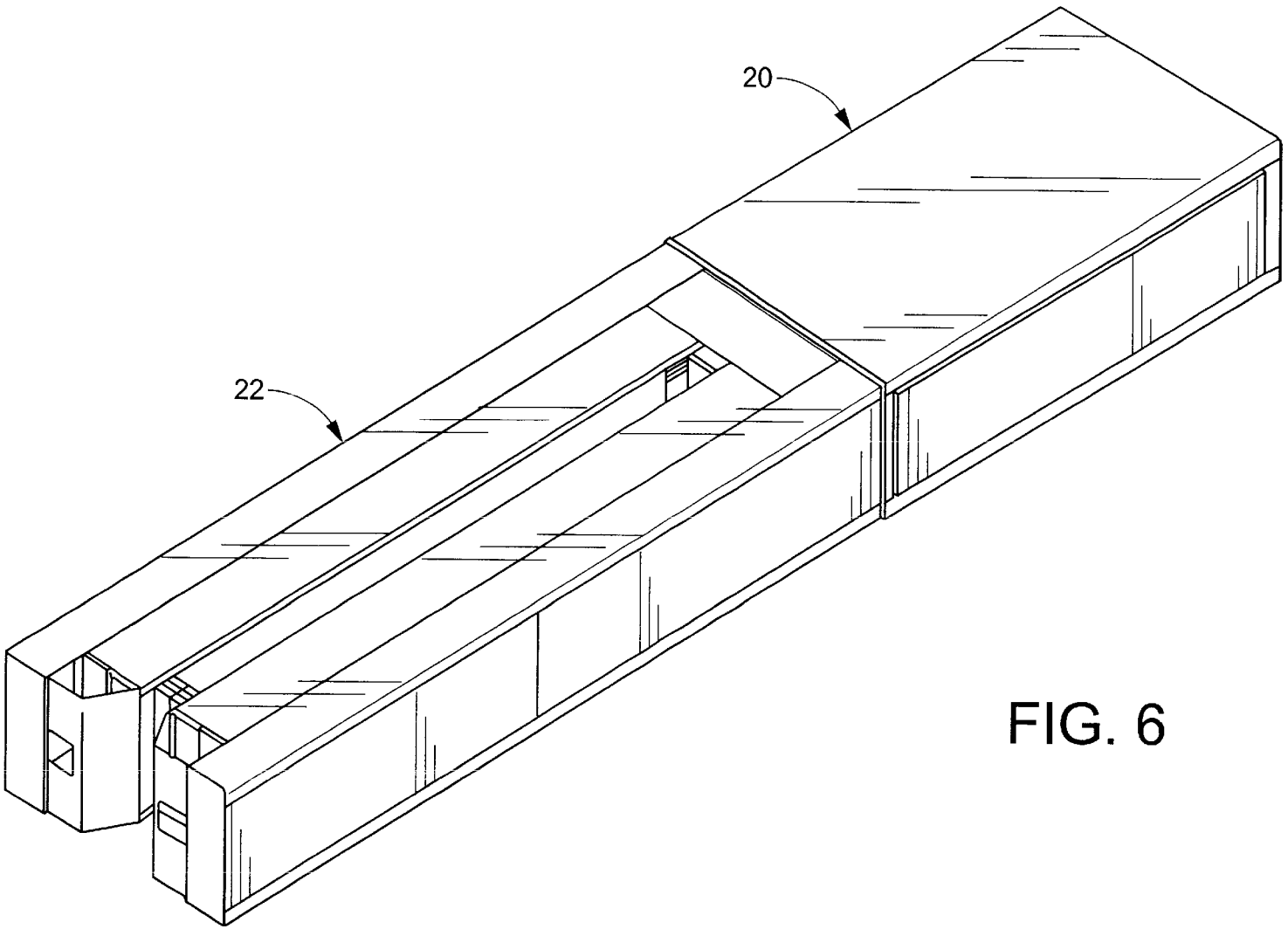
FIG. 6 is a partial perspective view of a capacitor bank and induction coil assembled in accordance with the present invention.

FIG. 6 illustrates a perspective view of the coil and bank assembly and it is important to note that the bank and coil are directly adjacent one another so that conventional connecting arrangements of cables, cooling hoses and multiple connectors are avoided. The capacitor and the coil are single assemblies with just one contact, comprising the bolting arrangement between the collector bus 38 and the coil.

Figure 9:
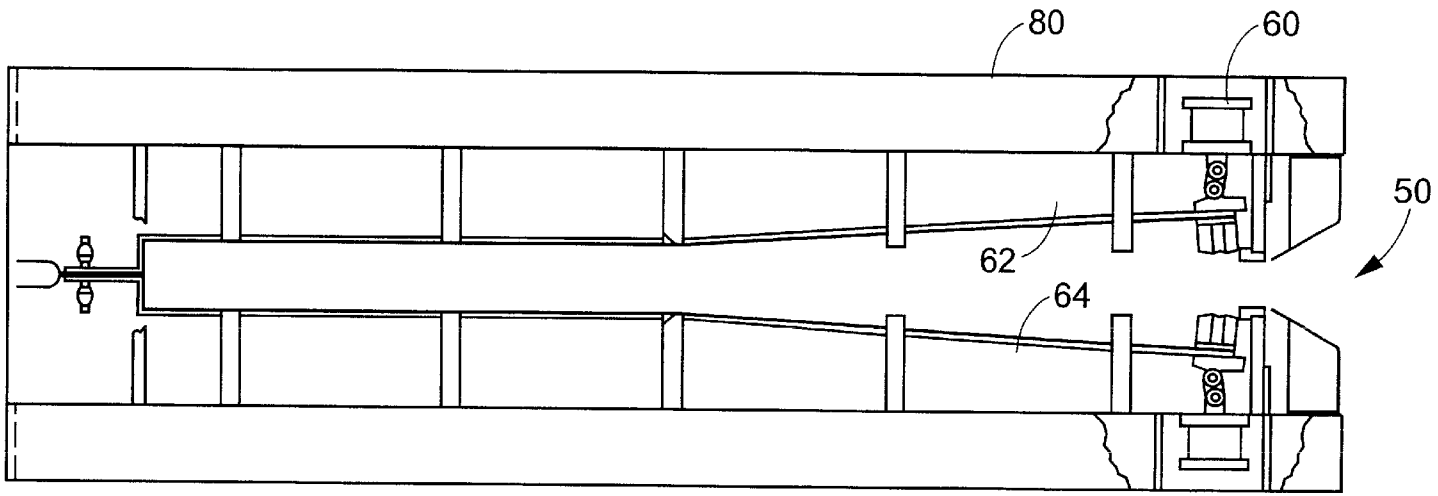
FIG. 9 is a side-elevational view showing the coil deflected into an open position for removal from the strip; and, FIG. 10 is a partial cross-sectional view particularly illustrating the knife switch components of the coil.

With continued reference to FIGS. 6, 7 and 9, another feature of the subject invention is that the coil construction includes a selectively openable knife switch 50 at the coil end opposite the capacitor bank to facilitate opening and removal of the coil 22 upon the moving strip 12. As opposed to prior art systems which require hinges and doors, the subject invention comprises a switch 50 which is operated by deforming the coil 22 to open the switch with a spacing sized for removing the assembly on and off of the strip 12. Thus, when the switch is closed, the coil comprises a closed loop coil including a plurality of turns disposed about the strip. In order to open the coil, the turns operate as a pivot arm to facilitate separation of switch components. Thus, the turn acting also as a pivot arm, comprises an integral and resilient conductor, and the opening of the switch comprises a resilient arcing of the pivot arm to an extent necessary to open the switch to allow the coil to be removed from about the strip. The resilient arcing of the turn must be less than a yielding bending of the conductor for avoiding fatiguing over a plurality of openings and closings of the switch 50. FIG. 9 illustrates the deflection of the coil affected by opposed actuators 60 essentially comprising piston and cylinder assemblies which pull the ends 62, 64 of the coil away from each other.

Figure 10:
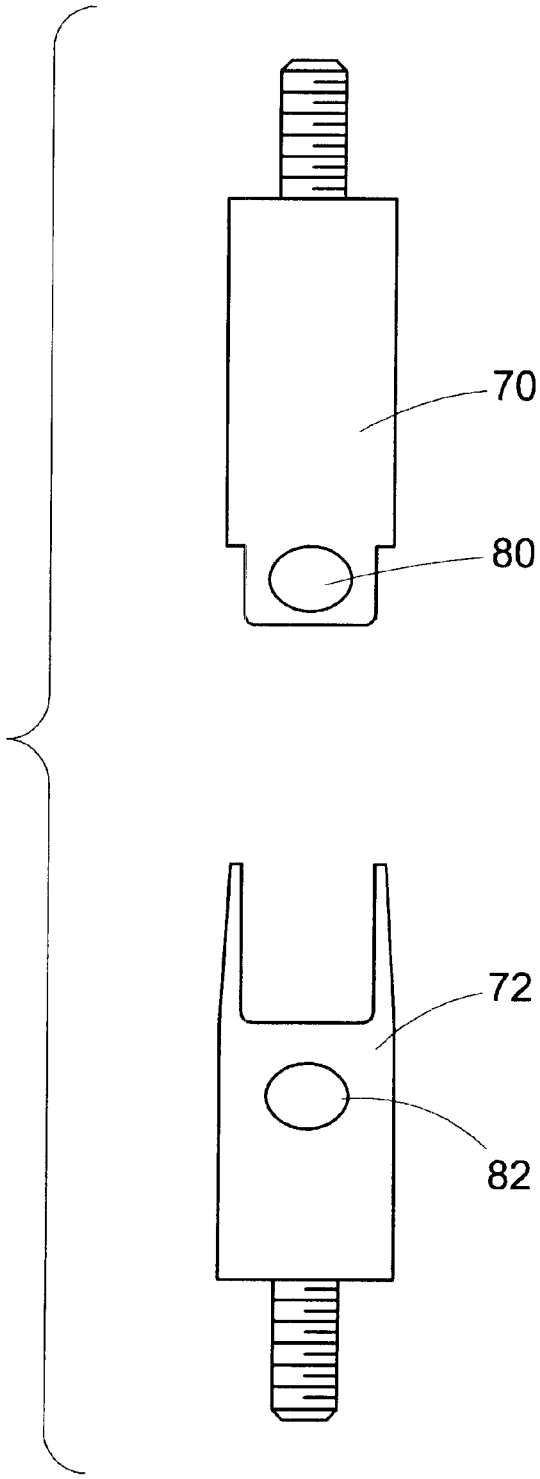

With additional reference to FIG. 10, it can be seen that the switch 50 preferably comprises a knife switch extending over a cross-sectional length of the coil. By "length" is meant the approximate dimension of the coil that the strip passes through. A male part 70 is associated with the first end 62 of the coil and the female part 72 is associated with second end 64 of the coil. In operation, as the actuators 60 are fixedly supported on the base frame 80, deflection of the coil causes the male and female components to mate or separate. The forks of the female component 72 are slightly spread upon reception of the male component 70 for enhanced electrical contact.

Another feature of the invention to note is that the alignment of the switch assembly 50 is disposed to allow the current, which runs on the inside surface (i.e., on the inside of the coil opening) to run along a more expansive dimension of the switch than if the switch were aligned otherwise to cause the current to run along merely the knife edge. Accordingly, only a single contact switch would be possible, but the double contact assembly of the preferred embodiment provides enhanced structural strength. The switch is water cooled as can be seen with coolant passageways 80, 82.

The invention is described with reference to the preferred embodiments obviously, modifications and alterations will occur to others upon the reading and understanding of this specification. It is our intention to include all such modifications and alterations insofar as they come within the scope of the appended claims or the equivalents thereof.

Having thus described our invention, we now claim:

1. An electric induction heating assembly comprising:

an induction coil for heating a continuous strip passing therethrough and including an accessway comprising a switch supported by a turn of the coil; and, a capacitor bank for supplying a reactive portion of current to the coil wherein the bank is disposed adjacent the coil and includes a housing configured for shielding capacitors within the bank from a magnetic field of the coil.

2. The assembly as defined in claim 1 wherein the housing further includes a conduit in communication with a source of coolant for cooling the bank.

3. The assembly as defined in claim 2 wherein the housing comprises an electrically and thermally conductive heat sink.

4. The assembly as defined in claim 3 wherein the bank comprises a plurality of capacitors and a plurality of the heat sinks.

5. The assembly as defined in claim 4 wherein the capacitors are configured as toroidal roll packs disposed between a first and second of the heat sinks.

6. The assembly as defined in claim 5 including a collector bus in electrical communication with the capacitors and the coil.

7. The assembly as defined in claim 6 wherein a plurality of the roll packs are serially connected to the bus and each of the roll packs is interposed between a pair of the plurality of heat sinks for forming a stack.

8. The assembly as defined in claim 7 wherein the bus comprises a pair of buses, each of the pair being connected to an associated stack of capacitors and heat sinks.

9. The assembly as defined in claim 8 wherein the pair of buses are spaced by an insulator.

10. The assembly as defined in claim 1 wherein the switch is selectively openable and an actuator for deforming the coil to open the switch with a spacing sized for moving the assembly on and off of the strip.

11. The assembly as defined in claim 10 further including a carriage for the moving of the assembly on and off the strip wherein the carriage supports the coil and the capacitor bank.

12. An induction heater for heating a continuous strip wherein the heater is selectively moved on and off the strip, the heater comprising a closed loop coil to be disposed about the strip and including an accessway within the coil for selectively opening the coil for the movement relative to the strip;

the accessway comprising a switch supported by a turn of the coil; and, the heater further comprising an actuator associated with the turn for deflecting the turn to an extent to open the switch.

13. The heater as claimed in claim 12 wherein the turn comprises a pivot arm for the switch.

14. The heater as claimed in claim 13 wherein the pivot arm comprises an integral and resilient conductor and wherein the deflecting comprises a resilient arcing of the pivot arm.

15. The heater as claimed in claim 14 wherein the resilient arcing is less than a yielding bending of the conductor for avoiding fatiguing of the conductor over a plurality of openings and closings of the switch.

16. The heater as claimed in claim 12 wherein the switch comprises a knife switch extending for a length of the coil.

17. The heater as claimed in claim 16 wherein a male part of the switch is associated with a first end of the coil and a female part of the switch is associated with a second end of the coil.

18. The heater as claimed in claim 12 wherein the actuator comprises a piston and cylinder assembly supported on a base frame and fastened to the coil for the deflecting of the coil turn.

19. The heater as claimed in claim 12 further including a trolley supporting the coil and facilitating the movement of the heater relative to the strip.

20. The heater as claimed in claim 19 further including a flat pack capacitor bank in electrical communication with the coil, wherein said bank is also supported by the trolley.

21. An induction heating assembly particularly adapted for heating a continuous strip wherein the assembly is selectively removable from the strip and packaged for improved convenience in movement on and off the strip, comprising:

a coil for inductive heating of the strip comprising a closed loop with a mating connector at one segment of the loop, and a coil turn at another segment of the loop, the coil turn having an associated actuator for selective arcing of the turn to open the connector for the movement of the assembly on and off the strip;

a capacitor bank connected to the coil for the supply of reactive power thereto, the bank having a shield protecting capacitors within the bank from field effects of the coil; and, a trolley supporting the coil, the actuator and the bank and for moving the assembly on and off the strip.

22. The assembly as defined in claim 21 wherein the shield includes a conduit for coolant, the shield further comprising a heat sink.

23. The assembly as defined in claim 21 wherein the capacitor bank is fastened to the coil, electrically intermediate a power supply and the coil.

24. The assembly as defined in 21 wherein the capacitor bank comprises a selectively stackable modular pack of a plurality of the capacitors.

25. The assembly as defined in claim 21 wherein the connector comprises a knife switch disposed so that a side wall of a blade of the knife carries coil current.

* * * * *